United States Patent [19]

Mancini

[11] Patent Number: 4,958,573

[45] Date of Patent: Sep. 25, 1990

[54] REHABILITATION MACHINE HAVING ITS FEED AND DISCHARGE OF MATERIALS AT ITS LEADING END IN THE DIRECTION OF ITS ADVANCE

[75] Inventor: Flavio Mancini, Brescia, Italy

[73] Assignees: Danieli & C. Officine Meccaniche S.p.A.; ITI/CLM Impianti Tecnici Industriali S.p.A., both of Buttrio, Italy

[21] Appl. No.: 220,686

[22] Filed: Jul. 18, 1988

[30] Foreign Application Priority Data

Aug. 7, 1987 [IT] Italy ..... 83434 A/87

[51] Int. Cl.[5] ..... E01B 29/05

[52] U.S. Cl. ..... 104/2

[58] Field of Search ..... 104/2, 7.3; 171/16; 37/104–107

[56] References Cited

U.S. PATENT DOCUMENTS

| | | | |
|---|---|---|---|
| 2,737,901 | 3/1956 | Drouard et al. | 104/7.3 |
| 3,872,929 | 3/1975 | Teurer et al. | 104/2 X |
| 3,957,000 | 5/1976 | Plasser et al. | 104/2 X |
| 3,976,142 | 8/1976 | Plasser et al. | 104/2 X |
| 4,357,874 | 11/1982 | Theurer | 104/2 |
| 4,479,439 | 10/1984 | Theurer et al. | 104/2 X |
| 4,502,389 | 3/1985 | Theurer et al. | 104/2 |
| 4,538,687 | 9/1985 | Theurer et al. | 104/2 X |

FOREIGN PATENT DOCUMENTS

| | | | |
|---|---|---|---|
| 0184236 | 6/1986 | European Pat. Off. . | |
| 523923 | 4/1931 | Fed. Rep. of Germany . | |
| 277935 | 7/1975 | France . | |
| 291449 | 9/1953 | Switzerland | 104/2 |
| 323533 | 9/1957 | Switzerland | 104/2 |

*Primary Examiner*—Margaret A. Focarino
*Assistant Examiner*—Joseph D. Pape
*Attorney, Agent, or Firm*—Wegner & Bretschneider

[57] ABSTRACT

Rehabilitation machine (10) for railway road beds, which comprises a framework (11) rested on a front bogie (12) and rear bogie (13), cabs (14–15) to drive the machine during its travels, an excavation chain (20) cooperating with a hopper (21) in the transfer of excavated material onto an elevator (22), and a leading end (24) and trailing end (124) relative to the direction of advance (19) of the machine (10), and also comprises at one end a first front conveyor (27) to deliver a mixture of aggregate materials (26) and a second front conveyor (33) to deliver metalling (32) towards the machine (10) and also discharge conveyors (23) to discharge excavated material from the machine (10).

9 Claims, 2 Drawing Sheets

REHABILITATION MACHINE HAVING ITS FEED AND DISCHARGE OF MATERIALS AT ITS LEADING END IN THE DIRECTION OF ITS ADVANCE

BACKGROUND OF THE INVENTION

This invention concerns a rehabilitation machine having its feed and discharge of materials at its leading end in the direction of advance of the working train.

To be more exact, the invention concerns a rehabilitation machine able to receive metalling and mixture of aggregate materials necessary for rehabilitation works from storage wagons coupled to the leading end of the rehabilitation machine.

The rehabilitation machine according to the invention is also able to discharge materials which cannot be re-used, after the rehabilitation work, in cooperation with the storge wagons, which are then employed to hold such materials.

This provides the advantage of having the end of the rehabilitation machine, facing the rehabilitated portion of line, wholly free for coupling to a machine for reinforcing and, more generally, for finishing the rehabilitated road bed.

Rehabilitation machines suitable for excavation work and for laying a mixture of aggregate materials and depositing new metalling are known in the prior art.

Such machines are very complex and expensive and consist, in their order of forward movement along the railway line, of a motive unit, a main unit to excavate and lay materials and a satellite unit to finish the railway line.

To the satellite unit is connected a train of containers, which are generally operated with portals, to feed materials to the main unit.

A train of storage wagons to hold materials discharged by the machine is coupled to the main unit at the head of the machine.

This lay-out entails a plurality of drawbacks. The feed at one end and the discharge at the other end form a considerable constructional problem since they have to pass over the satellite unit and motive unit in the delivery of materials to their usage positions.

The train of containers at one end and the train of storage wagons at the other end lead to the creation of a train of a great length.

Moreover, a long train of containers on the satellite unit end hinders early use of the rehabilitated line by successive trains.

The present applicants have designed, tested and embodied a rehabilitation machine able to overcome all the problems of the pior art.

SUMMARY OF THE INVENTION

The rehabilitation machine according to the invention has an inlet for materials fed to it and an outlet for materials to be discharged, at its leading end for movement along the railway line.

Its opposite end is wholly free for use in coupling other machines, such as reinforcement machines and the like.

The rehabilitation machine cooperates with appropriate storage wagons able to feed materials or to receive and store discharged materials.

The rehabilitation machine comprises separate conveyors for the aggregate mixture and new metalling respectively, these conveyors cooperating at differentiated positions with one and the same conveyor, which distributes the materials to be deposited.

This distributor conveyor in turn provides for the laying of new materials on the road bed in cooperation with stationary distributor means.

The rehabilitation machine comprises an excavation chain cooperating with a hopper in the transfer of excavated material onto an elevator.

From the elevator, which is driven in the opposite direction to the conveyors feeding materials, the material is transferred by appropriate means to a discharge conveyor moving in the same direction as the elevator so as to remove excavated materials from the rehabilitation machine.

The machine comprises known means to compact the bottom of the excavation, known means to spread evenly or to level the aggregate mixture deposited on the bottom of the excavation which are connected to other compaction means, and known means to spread the metalling evenly when discharged onto the road bed.

The invention is therefore characterized by the contents of claim 1 and the dependent claims.

BRIEF DESCRIPTION OF THE DRAWING

The attached figures which are given as a non-restrictive example, show the following.

DESCRIPTION OF THE PREFERRED EMBODIMENTS

A rehabilitation machine 10 comprises a framework 11 rested, in this example, on a front bogie 12 and rear bogie 13.

Two cabs 14–15 for driving the machine during its travels are provided at its ends.

Figure 1:
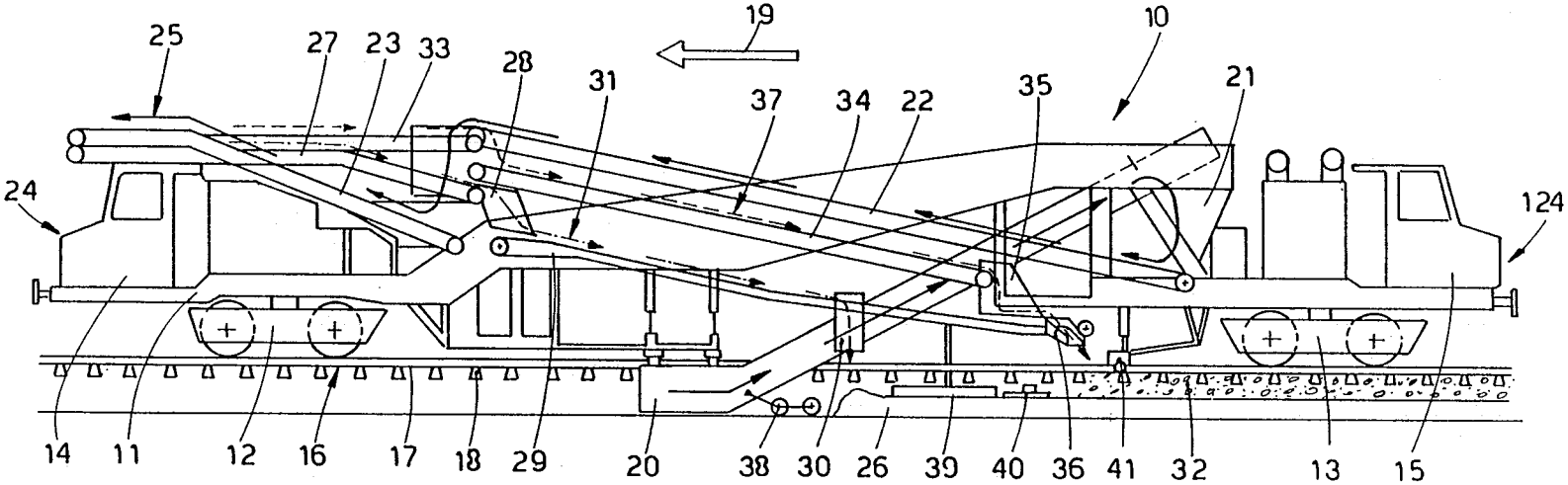
FIG. 1 gives a diagram of the side of the rehabilitation machine according to the invention.

FIG. 1 shows a railway line 16 with rails 17 and sleepers 18. The direction of forward movement of the machine 10 is indicated by an arrow 19.

The machine 10 comprises an excavation chain 20, which is known in itself, to transfer excavated material through a hopper 21 onto an elevator 22.

The excavated material is suitably transferred from the elevator 22 onto a discharge conveyor 23, which delivers the material to the leading end 24 of the machine in the direction 19 of advance of the machine.

Figure 3:
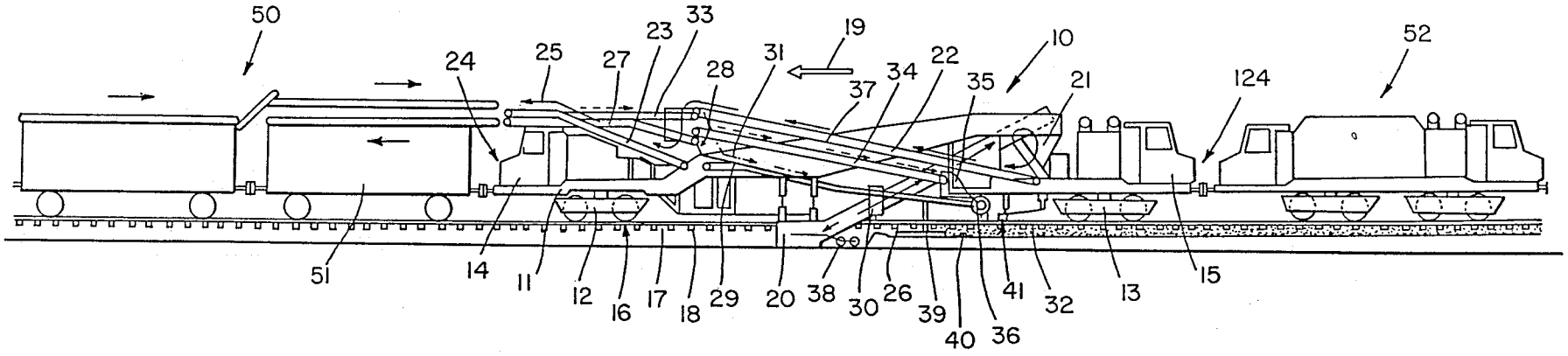
FIG. 3 gives a diagram of a side view of the rehabilitation machine connected to a train of wagons at its leading end and an operational machine at its trailing end.

At the leading end 24 of the machine the discharge conveyor 23 cooperates with analogous conveyors on storage wagons 51 connected to the leading end 24 of the machine 10 and providing storage space for excavated material. A train of wagons 50 is connected to the leading end 24 of the machine 10 to store feed materials and excavated material, as shown in FIG. 3.

The trailing end 124 of the machine remains free for connection to other machines 52 involved in the rehabilitation work.

Figure 2:
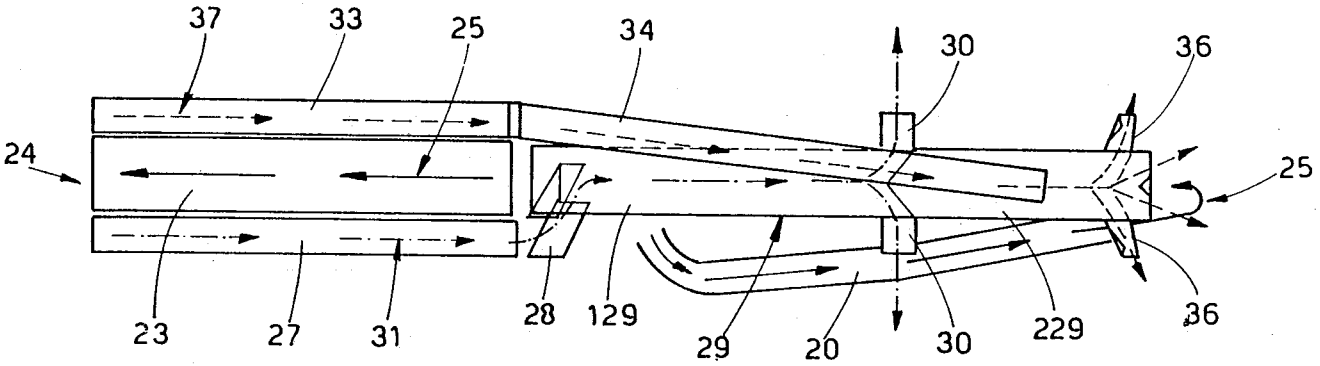
FIG. 2 gives a diagram from above of a possible flow of materials in the rehabilitation machine according to the invention.

In FIGS. 1 and 2 the flow 25 of excavated material is shown with arrows having continuous lines.

For the sake of clarity the flow of excavated material in FIG. 2 is interrupted at the righthand end of the figure and then re-starts on the discharge conveyor 23 in the lefthand portion of the figure, but the flow can be readily identified with the arrows 25 in FIG. 1.

A mixture of aggregate materials 26, normally sand and gravel, arrives advantageously at the leading end 24 of the machine from the same storage wagons as are used to store the excavated material.

The aggregate mixture 26 is fed to a first front conveyor 27, which feeds it through a transfer assembly 28 in turn to a distributor conveyor 29.

The aggregate mixture 26 is distributed by the distributor conveyor 29 along first distribution channels 30 to the excavation made by the excavation chain 20.

In FIGS. 1 and 2 the flow of aggregate mixture 26 is marked with 31 and shown with arrows consisting of dots and dashes.

In the same manner as the aggregate mixture 26, metalling 32 is brought to a second front horizontal conveyor 33, which feeds it to a rear conveyor 34, which in turn transfers it to the distributor conveyor 29 through a transfer unit 35.

The zone of transfer of the metalling 32 onto the distributor conveyor 29 by the rear conveyor 34 is situated further rearwards, in relation to the direction of forward movement 19, than the zone of transfer of the aggregate mixture 26 onto the distributor conveyor 29 by the first front conveyor 27.

Two segments of conveying and distribution of materials on the distributor conveyor 29 are defined in this way, namely 129 for the aggregate mixture 26 and 229 for the metalling 32.

The metalling 32 is distributed at the end of the distributor conveyor 29 by means of second distribution channels 36 onto the railway road bed.

In FIGS. 1 and 2 the flow of metalling 32 is referenced with 37 and shown with arrows consisting of dashes.

FIG. 1 shows also items forming part of the prior art, namely an assembly 38 to compact the bottom of the excavation, an assembly 39 connected to a compaction unit 40 and employed to spread the aggregate mixture 26 evenly, and an assembly 41 to spread the metalling 32 evenly, all these assemblies being connected to the rehabilitation machine.

I claim:

1. A rehabilitation apparatus for railway road beds, comprising a rehabilitation machine including: a leading end and a trailing end relative to the direction of advance of the rehabilitation machine; a front bogie at the leading end and a rear bogie at the trailing end; a framework resting on said front and rear bogies; a cab at each said end for driving the rehabilitation machine; a hopper connected to the framework; an excavation chain for transferring excavated material through the hopper, and an elevator for receiving the excavated material transferred from the excavation chain through the hopper; and, located at one said end, a first conveyor for delivering a mixture of aggregate materials, a second conveyor for delivering metalling, and discharge conveyors for discharging excavated material from the machine.

2. A rehabilitation apparatus as recited in claim 1, wherein the one said end at which the first conveyor, the second conveyor and the discharge conveyors are located is the leading end.

3. A rehabilitation apparatus as recited in claim 1 or 2, further comprising a train of wagons for storing feed and excavated materials connected to the leading end of the rehabilitation machine.

4. A rehabilitation apparatus as recited in claim 3, further comprising operational machines connected to the trailing end of the rehabilitation machine.

5. A rehabilitation machine as recited in claim 1, wherein the rehabilitation machine further includes a distributor conveyor for conveying and distributing metalling and aggregate mixture, said distributor conveyor receiving the aggregate mixture from said first conveyor and the metalling from said second conveyor.

6. A rehabilitation apparatus for railway road beds, comprising a rehabilitation machine including: a leading end and a trailing end relative to the direction of advance of the rehabilitation machine; a front bogie at the leading end and a rear bogie at the trailing end; a framework resting on said front and rear bogies; a cab at each said end for driving the rehabilitation machine; a hopper connected to the framework, an excavation chain for transferring excavated material through the hopper, and an elevator for receiving the excavated material transferred from the excavation chain through the hopper; a first conveyor for delivering an aggregate mixture, a second conveyor for delivering metalling, and discharge conveyors for discharging excavated material form the machine, said first, second and discharge conveyors located at one said end; and a distributor conveyor for conveying and distributing metalling and aggregate mixture, said distributor conveyor receiving the aggregate mixture from said first conveyor and the metalling from said second conveyor, said distributor conveyor including a first segment for transporting and distributing the aggregate mixture and a second segment for transporting and distributing the metalling.

7. A rehabilitation apparatus as recited in claim 6, wherein the rehabilitation machine further includes a rear conveyor for receiving the metalling from said second conveyor and for transferring the metalling to said distributor conveyor.

8. A rehabilitation apparatus as recited in claim 6, wherein the rehabilitation machine further includes first distribution channels for distributing the aggregate mixture from the distributor conveyor, said first distribution channels separating said first segment and said second segment of the distributor conveyor.

9. A rehabilitation apparatus as recited in claim 8, wherein the rehabilitation machine further includes second distribution channels for distributing the metalling from the distributor conveyor, said second distribution channels located at the trailing end of said second segment of the distributor conveyor.

* * * * *